US011873746B2

(12) United States Patent
Nagai

(10) Patent No.: US 11,873,746 B2
(45) Date of Patent: Jan. 16, 2024

(54) VEHICLE

(71) Applicant: SUBARU CORPORATION, Tokyo (JP)

(72) Inventor: Ryo Nagai, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 0 days.

(21) Appl. No.: 18/138,369

(22) Filed: Apr. 24, 2023

(65) Prior Publication Data

US 2023/0374924 A1 Nov. 23, 2023

(30) Foreign Application Priority Data

May 20, 2022 (JP) ..... 2022-082906

(51) Int. Cl.
*F01N 3/023* (2006.01)
*F01N 13/00* (2010.01)
*F01N 11/00* (2006.01)

(52) U.S. Cl.
CPC ..... *F01N 3/0233* (2013.01); *F01N 11/007* (2013.01); *F01N 13/009* (2014.06); *F01N 2560/025* (2013.01)

(58) Field of Classification Search
CPC .... F01N 3/0233; F01N 11/007; F01N 13/009; F01N 2560/025
See application file for complete search history.

(56) References Cited

U.S. PATENT DOCUMENTS 7,299,626 B2 * 11/2007 Barasa ..... F02D 41/1456 60/276
8,181,452 B2 * 5/2012 Bidner ..... F01N 3/023 60/296
8,347,613 B2 * 1/2013 Van Nieuwstadt ..... F01N 9/002 60/285
8,516,797 B2 * 8/2013 Van Nieuwstadt .... F02M 26/05 60/296
2006/0191412 A1 * 8/2006 Sellers ..... F01N 3/0233 95/279
2006/0254263 A1 * 11/2006 Allansson ..... F01N 13/009 60/296

FOREIGN PATENT DOCUMENTS

JP 2021-127004 A 9/2021

* cited by examiner

*Primary Examiner* — Jesse S Bogue
(74) *Attorney, Agent, or Firm* — MCGINN I.P. LAW GROUP, PLLC.

(57) ABSTRACT

A vehicle includes a filter, a negative-pressure mechanism, and a first opening and closing mechanism. The filter is disposed in an exhaust passage coupled to an engine. The negative-pressure mechanism is configured to pressurize a portion of the exhaust passage upstream of the filter to a negative pressure less than an atmospheric pressure. The first opening and closing mechanism includes an opening disposed in the exhaust passage, and a valve configured to selectively open and close the opening. The valve is configured to, when the exhaust passage becomes negatively pressurized by the negative-pressure mechanism, open the opening.

4 Claims, 5 Drawing Sheets

VEHICLE

CROSS-REFERENCE TO RELATED APPLICATIONS

The present application claims priority from Japanese Patent Application No. 2022-082906 filed on May 20, 2022, the entire contents of which are hereby incorporated by reference.

BACKGROUND

The disclosure relates to a vehicle.

Exhaust gas from engines contain particulate matter (PM) such as soot. Vehicles are thus equipped with a filter to remove the particulate matter, such as a gasoline particulate filter (GPF) or a diesel particulate filter (DPF). Such a filter has holes for capturing the particulate matter to thereby remove the particulate matter from the exhaust gas. With its continued use, the filter becomes clogged with the particulate matter.

Accordingly, when the amount of particulate matter accumulated in the filter becomes greater than or equal to a predetermined amount, a regeneration process is executed for the filter. A regeneration process involves burning off particulate matter accumulated in the filter to thereby remove the particulate matter from the filter. For example, Japanese Unexamined Patent Application Publication (JP-A) No. 2021-127004 discloses a technique that, during a fuel-cut, supplies a mixture of fuel and intake air to a filter disposed in an exhaust passage without causing ignition of the mixture to thereby execute a regeneration process.

SUMMARY

An aspect of the disclosure provides a vehicle including a filter, a negative-pressure mechanism, and a first opening and closing mechanism. The filter is disposed in an exhaust passage coupled to an engine. The negative-pressure mechanism is configured to pressurize a portion of the exhaust passage upstream of the filter to a negative pressure less than an atmospheric pressure. The first opening and closing mechanism includes an opening disposed in the exhaust passage, and a valve configured to selectively open and close the opening. The valve is configured to, when the exhaust passage becomes negatively pressurized by the negative-pressure mechanism, open the opening.

BRIEF DESCRIPTION OF THE DRAWINGS

The accompanying drawings are included to provide a further understanding of the disclosure and are incorporated in and constitute a part of this specification. The drawings illustrate embodiments and, together with the specification, serve to describe the principles of the disclosure.

DETAILED DESCRIPTION

Figure 1:
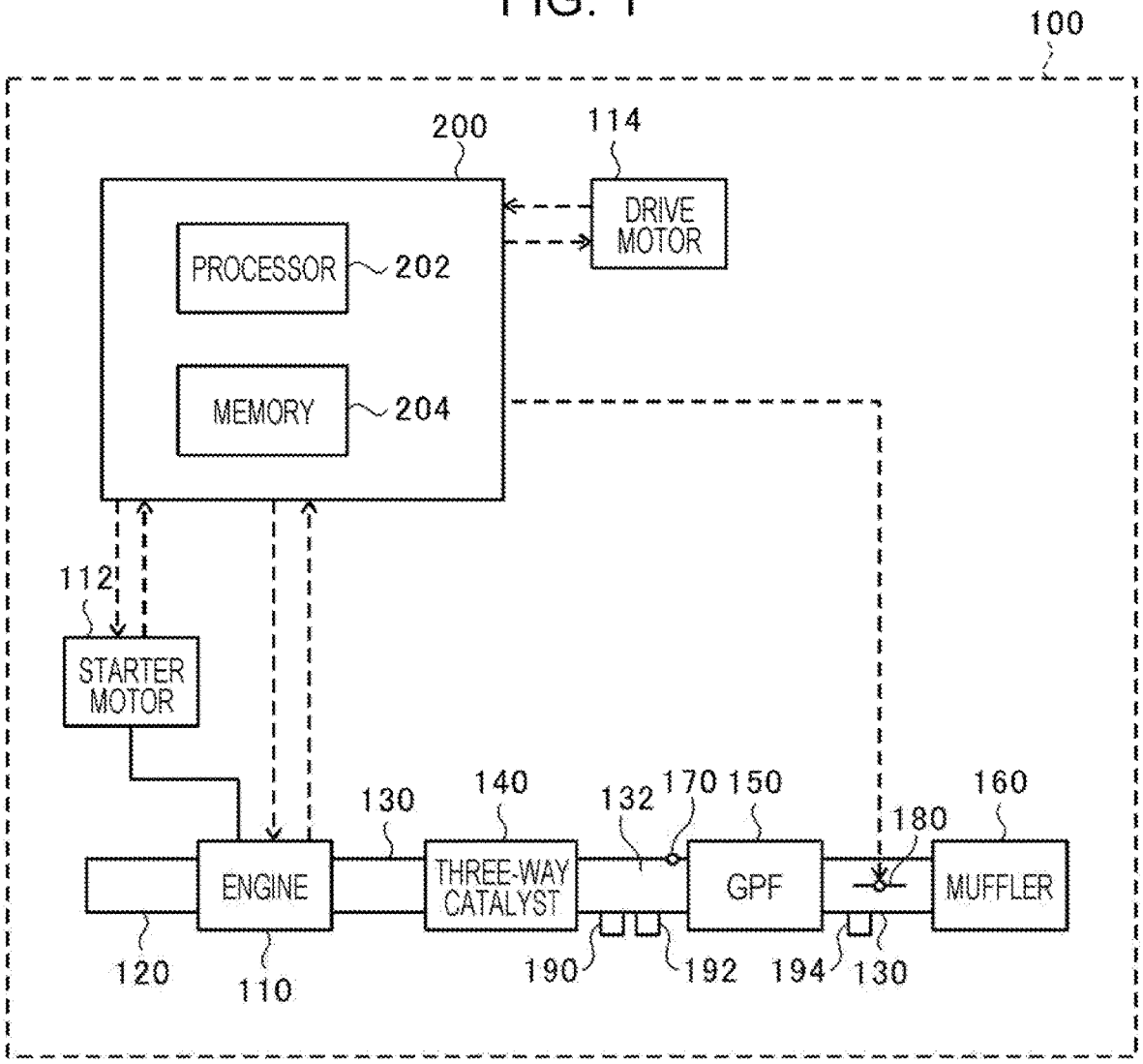
FIG. 1 schematically illustrates a configuration of a vehicle according to an embodiment of the disclosure.

With the technique described in JP-A No. 2021-127004, in executing a regeneration process, intake air passes through the entire exhaust passage from the engine. This may cause problems due to oxygen contained in the intake air, including degradation of a catalyst disposed in the exhaust passage, and reduced efficiency with which the exhaust gas is purified by the catalyst.

A demand therefore exists for a technique that allows oxygen to be supplied to a filter in a concentrated manner.

It is desirable to provide a vehicle that makes it possible to supply oxygen to a filter in a concentrated manner.

An embodiment of the disclosure is described below in detail with reference to the attached drawings. Dimensions, materials, numerical values, and other particular details described below with reference to the embodiment are given by way of example to facilitate understanding of the disclosure, and are, unless particularly stated otherwise, not limiting of the disclosure. In the specification and the drawings, elements that are substantially identical in function or configuration are designated by the same reference signs to avoid repetitive description, and elements not directly related to the disclosure are not illustrated in the drawings.

FIG. 1 schematically illustrates a configuration of a vehicle 100 according to the embodiment of the disclosure. Dashed arrows in FIG. 1 represent signal flow. In FIG. 1, arrows representing signal flow from an oxygen sensor 190 and pressure sensors 192 and 194 to a controller 200 are not illustrated.

As illustrated in FIG. 1, the vehicle 100 includes an engine 110, a starter motor 112, a drive motor 114, an intake passage 120, an exhaust passage 130, a three-way catalyst 140, a GPF 150, a muffler 160, a first opening and closing mechanism 170, a second opening and closing mechanism 180, the oxygen sensor 190, the pressure sensors 192 and 194, and the controller 200.

The vehicle 100 is a hybrid vehicle including the engine 110 and the drive motor 114 that serve as drive sources. The engine 110 is a gasoline engine. The starter motor 112 serves to start the engine 110.

The engine 110 has an intake port that communicates with an intake manifold. The collector part of the intake manifold communicates with the intake passage 120. In one example, the intake passage 120 is a pipe.

The engine 110 has an exhaust port that communicates with an exhaust manifold. The collector part of the exhaust manifold communicates with the exhaust passage 130. In one example, the exhaust passage 130 is a pipe. Exhaust gas from the engine 110 flows through the exhaust passage 130. An upstream location in the direction of flow of exhaust gas during normal rotation of the engine 110 is hereinafter sometimes referred to simply as "upstream." A downstream location in the direction of flow of exhaust gas is hereinafter sometimes referred to simply as "downstream." A rotation of the engine 110 in activating the drive system of the vehicle 100 is hereinafter referred to as normal rotation.

The three-way catalyst 140 is disposed in the exhaust passage 130. The three-way catalyst 140 removes hydrocarbon, carbon monoxide, and nitrogen oxide that are contained in the exhaust gas discharged from the engine 110. The three-way catalyst 140 contains, for example, precious metals such as platinum (Pt), palladium (Pd), and rhodium (Rh).

In one embodiment, the GPF 150 may serve as a "filter". The GPF 150 is disposed in a portion of the exhaust passage 130 downstream of the three-way catalyst 140. The GPF 150 traps particulate matter (soot) contained in the exhaust gas discharged from the engine 110.

The muffler 160 is disposed in a portion of the exhaust passage 130 downstream of the GPF 150. Exhaust gas purified by the three-way catalyst 140 and the GPF 150 is exhausted to the external environment through the muffler 160.

The first opening and closing mechanism 170 is disposed in a portion of the exhaust passage 130 between the three-way catalyst 140 and the GPF 150. The second opening and closing mechanism 180 is disposed in a portion of the exhaust passage 130 between the GPF 150 and the muffler 160.

Figure 2:
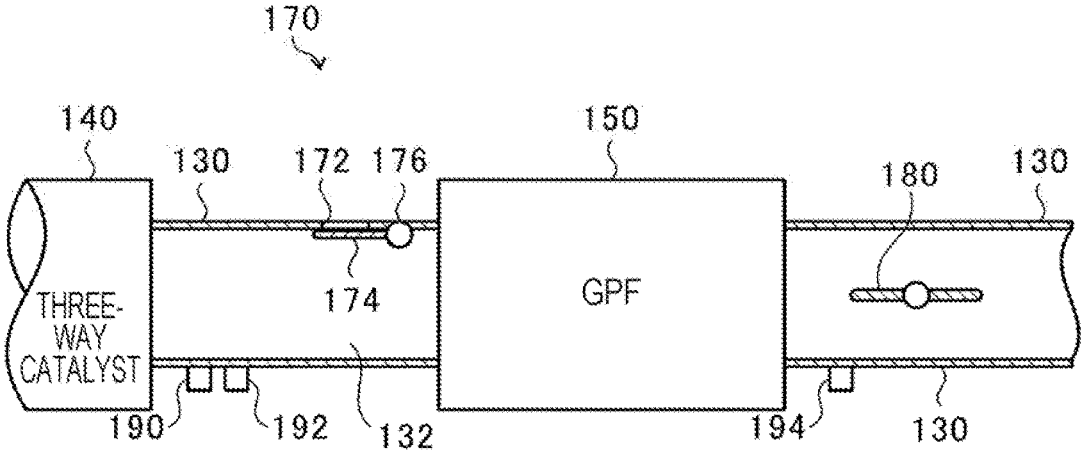
FIG. 2 is an illustration for explaining a first opening and closing mechanism and a second opening and closing mechanism according to the embodiment of the disclosure.

FIG. 2 is an illustration for explaining the first opening and closing mechanism 170 and the second opening and closing mechanism 180 according to the embodiment of the disclosure.

As illustrated in FIG. 2, the first opening and closing mechanism 170 includes an opening 172, and a valve 174. The opening 172 is disposed in a portion of the exhaust passage 130 upstream of the GPF 150. According to the embodiment, the opening 172 is located in a portion of the exhaust passage 130 between the three-way catalyst 140 and the GPF 150. The opening 172 provides communication between the inside of the exhaust passage 130 and the outside of the exhaust passage 130.

The valve 174 is disposed within the exhaust passage 130. A pivot 176 is disposed at one end of the valve 174. The valve 174 is configured to selectively open and close the opening 172. The valve 174 is configured to, when the interior of the exhaust passage 130 is at a positive pressure greater than or equal to the atmospheric pressure, close the opening 172. The valve 174 is configured to, when the interior of the exhaust passage 130 is at a negative pressure less than the atmospheric pressure, pivot away from the opening 172 as the valve 174 is pushed by outside air toward the inner part of the exhaust passage 130. The valve 174 is thus configured to open the opening 172 when the exhaust passage 130 becomes negatively pressurized.

The second opening and closing mechanism 180 is disposed in a portion of the exhaust passage 130 downstream of the opening 172. According to the embodiment, the second opening and closing mechanism 180 is disposed in a portion of the exhaust passage 130 downstream of the GPF 150. The second opening and closing mechanism 180 is configured to selectively open and close the exhaust passage 130. In one example, the second opening and closing mechanism 180 is a butterfly valve. The opening and closing action of the second opening and closing mechanism 180 is controlled by a negative-pressure control unit 214 described later.

Referring back to FIG. 1, the oxygen sensor 190 is disposed upstream of the GPF 150. According to the embodiment, the oxygen sensor 190 is disposed downstream and near the three-way catalyst 140. The oxygen sensor 190 is configured to detect the concentration of oxygen in a portion of the exhaust passage 130 between the three-way catalyst 140 and the GPF 150.

The pressure sensor 192 is disposed upstream of the GPF 150, and configured to detect the pressure in a portion of the exhaust passage 130 between the three-way catalyst 140 and the GPF 150. The pressure sensor 194 is disposed downstream of the GPF 150, and configured to detect the pressure in a portion of the exhaust passage 130 between the GPF 150 and the muffler 160.

In one embodiment, the controller 200 may serve as a "negative-pressure mechanism". The controller 200 includes one or more processors (hereinafter referred to simply as "processor") 202, and one or more memories (hereinafter referred to simply as "memory") 204 coupled to the processor 202. The processor 202 includes, for example, a central processing unit (CPU). The memory 204 includes, for example, a read only memory (ROM) and a random access memory (RAM). The ROM is a storage element that stores programs, computational parameters, and other data to be used by the CPU. The RAM is a storage element that temporarily stores variables, parameters, and other data to be used for processing to be executed by the CPU.

The controller 200 is configured to communicate with various devices disposed in the vehicle 100 (e.g., devices such as the engine 110, the starter motor 112, the drive motor 114, the second opening and closing mechanism 180, the oxygen sensor 190, and the pressure sensors 192 and 194). Communication between the controller 200 and each device is accomplished via, for example, Controller Area Network (CAN) communication.

Figure 3:
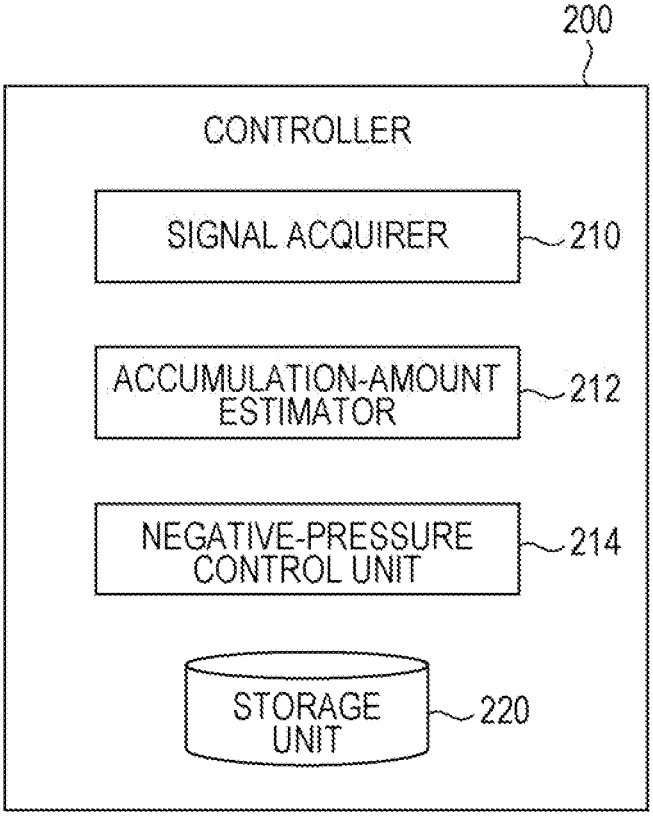
FIG. 3 is a block diagram illustrating an exemplary functional configuration of a controller according to the embodiment of the disclosure.

FIG. 3 is a block diagram illustrating an exemplary functional configuration of the controller 200 according to the embodiment of the disclosure. For example, as illustrated in FIG. 3, the controller 200 includes a signal acquirer 210, an accumulation-amount estimator 212, a negative-pressure control unit 214, and a storage unit 220. Various processes, including processes described later that are to be executed by the signal acquirer 210, the accumulation-amount estimator 212, and the negative-pressure control unit 214, may be executed by the processor 202. For example, various such processes are executed as the processor 202 executes a program stored in the memory 204.

The signal acquirer 210 is configured to acquire a value detected by the pressure sensor 192, and a value detected by the pressure sensor 194. The signal acquirer 210 is configured to acquire information indicative of whether the engine 110 is off and the vehicle 100 is being driven by the drive motor 114.

The accumulation-amount estimator 212 is configured to, based on a value detected by the pressure sensor 192 and a value detected by the pressure sensor 194, estimate the amount of accumulation of particulate matter in the GPF 150. For example, the accumulation-amount estimator 212 is configured to calculate the difference between a value detected by the pressure sensor 192 and a value detected by the pressure sensor 194. The difference represents a differential pressure between locations upstream and downstream of the GPF 150 (hereinafter referred to simply as "differential pressure"). The accumulation-amount estimator 212 then estimates, based on the differential pressure, the amount of accumulation of particulate matter in the GPF 150.

The accumulation-amount estimator 212 is configured to, when the differential pressure is greater than or equal to a threshold pressure, determine that the amount of accumulation of particulate matter in the GPF 150 has become greater than or equal to a threshold amount. The threshold pressure is determined in advance based on the differential pressure, and the amount of accumulation of particulate matter. For example, the threshold pressure is determined as a differential pressure corresponding to the maximum amount of accumulated particulate matter that can be burned off without causing abnormal combustion during the regeneration process. Information representative of the threshold pressure is retained in the storage unit 220.

The negative-pressure control unit 214 is configured to, when the differential pressure becomes greater than or equal to the threshold pressure, and when the engine 110 is off and the vehicle 100 is being driven by the drive motor 114, pressurize a portion of the exhaust passage 130 upstream of the GPF 150 to a negative pressure that is less than the atmospheric pressure. According to the embodiment, the negative-pressure control unit 214 is configured to negatively pressurize the exhaust passage 130 by cutting off the transmission of power between the engine 110 and the power transmission system, and controlling the starter motor 112 so as to rotate the engine 110 in the reverse direction. Rotating the engine 110 in the reverse direction (hereinafter also referred to simply as "reverse rotation") means rotating the engine 110 in a direction opposite to the direction of normal rotation.

The negative-pressure control unit 214 is configured to, in rotating the engine 110 in the reverse direction, that is, in negatively pressurizing the exhaust passage 130, activate the second opening and closing mechanism 180 so as to close the exhaust passage 130.

Figure 4:
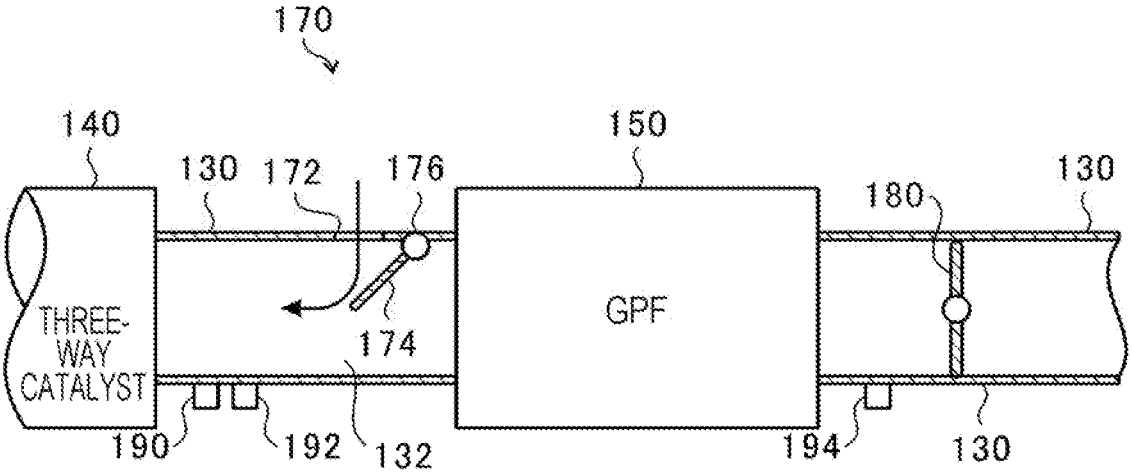
FIG. 4 is an illustration for explaining the first opening and closing mechanism and the second opening and closing mechanism when the exhaust passage is at a negative pressure.

FIG. 4 is an illustration for explaining the first opening and closing mechanism 170 and the second opening and closing mechanism 180 when the exhaust passage 130 is at a negative pressure. A solid arrow in FIG. 4 represents the flow of outside air.

As illustrated in FIG. 4, when the engine 110 is rotated in the reverse direction with the exhaust passage 130 being closed by the second opening and closing mechanism 180 at a location downstream of the GPF 150, gas (e.g., exhaust gas) within the exhaust passage 130 is sucked into the engine 110. A portion of the exhaust passage 130 upstream of the second opening and closing mechanism 180 thus becomes negatively pressurized.

This causes the valve 174 of the first opening and closing mechanism 170 to pivot away from the opening 172 as the valve 174 is pushed by outside air toward the inner part of the exhaust passage 130. The opening 172 is thus opened by the valve 174. In this way, outside air is supplied into the exhaust passage 130 through the opening 172.

The negative-pressure control unit 214 is configured to, when the oxygen concentration detected by the oxygen sensor 190 becomes greater than or equal to a predetermined threshold, control the starter motor 112 so as to stop the reverse rotation of the engine 110, and thereby release the negative pressure in the exhaust passage 130. This causes outside air to be stored in a region 132 of the exhaust passage 130 between the three-way catalyst 140 and the GPF 150. The threshold is set to the concentration of oxygen contained in outside air (e.g., 21%). Information representative of the threshold is retained in the storage unit 220.

The outside air stored in the region 132 of the exhaust passage 130 is entrained into the flow of exhaust gas that is introduced into the exhaust passage 130 when the engine 110 is rotated in the normal direction next time, and then the entrained outside air reaches the GPF 150. A regeneration process is thus executed for the GPF 150.

Filter Management Method

Figure 5:
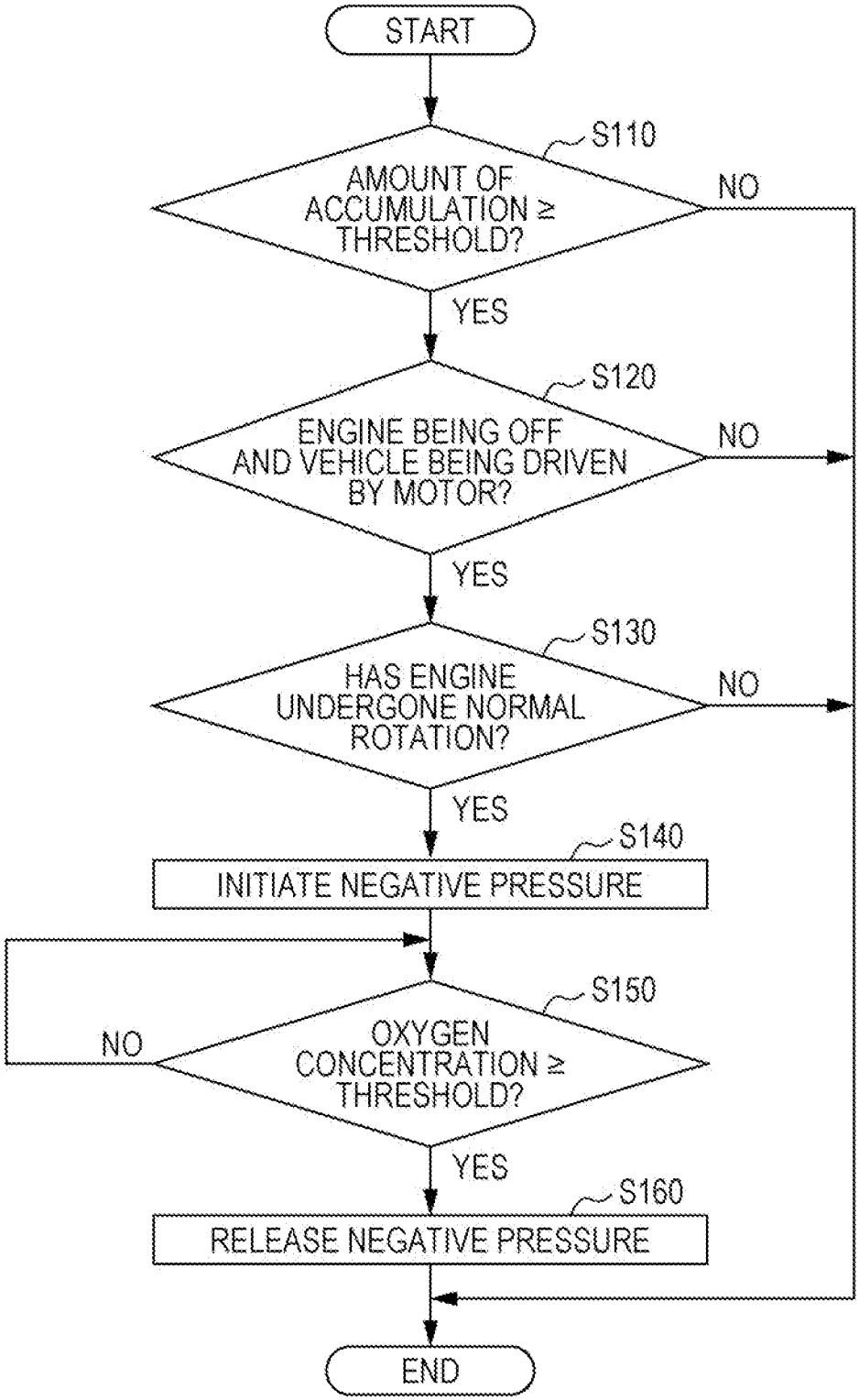
FIG. 5 is a flowchart of a procedure for a filter management method according to the embodiment of the disclosure.

FIG. 5 is a flowchart of a procedure for a filter management method according to the embodiment of the disclosure. According to the embodiment, the filter management method is carried out in response to an interrupt that occurs at predetermined time intervals.

As illustrated in FIG. 5, the filter management method includes an accumulation-amount determination process S110, an operational-state determination process S120, a normal-rotation-execution determination process S130, a negative-pressure initiation process S140, a second concentration determination process S150, and a negative-pressure release process S160. These processes are described below in detail.

Accumulation-Amount Determination Process S110

The accumulation-amount estimator 212 determines whether the amount of accumulation of particulate matter in the GPF 150 has become greater than or equal to a threshold amount. In a case where the accumulation-amount estimator 212 determines as a result that the amount of accumulation has become greater than or equal to the threshold amount (YES at S110), the accumulation-amount estimator 212 proceeds to the operational-state determination process S120. In a case where the accumulation-amount estimator 212 determines that the amount of accumulation has not become greater than or equal to the threshold amount, that is, the amount of accumulation is less than the threshold amount (NO at S110), the accumulation-amount estimator 212 ends the filter management method.

Operational-State Determination Process S120

The negative-pressure control unit 214 determines whether the engine 110 is off and the vehicle 100 is being driven by the drive motor 114. In a case where the negative-pressure control unit 214 determines as a result that the engine 110 is off and that the vehicle 100 is being driven by the drive motor 114 (YES at S120), the negative-pressure control unit 214 proceeds to the normal-rotation-execution determination process S130. In a case where the negative-pressure control unit 214 determines that the engine 110 is not off or that the vehicle 100 is not being driven by the drive motor 114 (NO at S120), the negative-pressure control unit 214 ends the filter management method.

Normal-Rotation-Execution Determination Process S130

The negative-pressure control unit 214 determines whether the engine 110 has undergone normal rotation since the last execution of the negative-pressure release process S160. According to the embodiment, the negative-pressure control unit 214 determines, based on a detection value from the oxygen sensor 190 acquired by the signal acquirer 210, whether the oxygen concentration upstream of the region 132 of the exhaust passage 130 is greater than or equal to a threshold. In a case where the negative-pressure control unit 214 determines as a result that the oxygen concentration is greater than or equal to the threshold, that is, the engine 110 has not undergone normal direction since the last execution of the negative-pressure release process S160 (NO at S130), the negative-pressure control unit 214 ends the filter management method. In a case where the negative-pressure control unit 214 determines that the oxygen concentration is less than the threshold, that is, the engine 110 has undergone normal direction since the last execution of the negative-pressure release process S160 (YES at S130), the negative-pressure control unit 214 proceeds to the negative-pressure initiation process S140.

Negative-Pressure Initiation Process S140

The negative-pressure control unit 214 pressurizes the exhaust passage 130 to a negative pressure that is less than the atmospheric pressure. According to the embodiment, the negative-pressure control unit 214 cuts off the transmission of power between the engine 110 and the power transmission system, and controls the starter motor 112 so as to rotate the engine 110 in the reverse direction. The negative-pressure control unit 214 also controls the second opening and closing mechanism 180 so as to close the exhaust passage 130. The opening 172 is thus opened by the valve 174 of the first opening and closing mechanism 170. This allows outside air to be supplied to the region 132 of the exhaust passage 130 through the opening 172.

Second Concentration Determination Process S150

The negative-pressure control unit 214 determines, based on a detection value from the oxygen sensor 190 acquired by the signal acquirer 210, whether the oxygen concentration in the region 132 of the exhaust passage 130 is greater than or equal to a threshold. In a case where the oxygen concentration is less than the threshold (NO at S150), the negative-pressure control unit 214 repeats the second concentration determination process S150 until the oxygen concentration becomes greater than or equal to the threshold. Once the oxygen concentration becomes greater than or equal to the threshold (YES at S150), the negative-pressure control unit 214 proceeds to the negative-pressure release process S160.

Negative-Pressure Release Process S160

The negative-pressure control unit 214 pressurizes the exhaust passage 130 to a pressure greater than or equal to the atmospheric pressure. According to the embodiment, the negative-pressure control unit 214 controls the starter motor 112 so as to stop the reverse rotation of the engine 110. The negative-pressure control unit 214 also controls the second opening and closing mechanism 180 so as to open the exhaust passage 130. The opening 172 is thus closed by the valve 174 of the first opening and closing mechanism 170.

As described above, the vehicle 100 according to the embodiment is capable of, when the exhaust passage 130 becomes negatively pressurized, supplying outside air (oxygen) to a portion of the exhaust passage 130 upstream of the GPF 150, and causing the outside air to be temporarily stored in the region 132 of the exhaust passage 130. This makes it possible to, when the engine 110 is rotated in the normal direction next time and exhaust gas thus flows through the exhaust passage 130, supply the outside air stored in the region 132 of the exhaust passage 130 to the GPF 150, together with the flow of the exhaust gas.

The vehicle 100 thus allows air (oxygen) to be supplied to the GPF 150 in a concentrated manner. This makes it possible to prevent oxygen from passing through the entire exhaust passage 130 from the engine 110 during execution of a regeneration process. The vehicle 100 is thus capable of reducing, for example, oxygen-induced degradation of the three-way catalyst 140, or a decrease in the efficiency with which exhaust gas is purified by the three-way catalyst 140.

As described above, the negative-pressure control unit 214 is configured to negatively pressurize the region 132 of the exhaust passage 130 simply by means of reverse rotation of the engine 110. This allows the region 132 of the exhaust passage 130 to be negatively pressurized without providing the vehicle 100 with a dedicated mechanism for negatively pressurizing the region 132 of the exhaust passage 130.

As described above, the vehicle 100 includes the second opening and closing mechanism 180. This allows the vehicle 100 to further reduce the pressure in the region 132 of the exhaust passage 130. The vehicle 100 is thus capable of supplying outside air to the region 132 of the exhaust passage 130 in a short time.

As described above, the negative-pressure control unit 214 is configured to, when the oxygen concentration detected by the oxygen sensor 190 becomes greater than or equal to a threshold, pressurize the exhaust passage 130 to a pressure greater than or equal to the atmospheric pressure. This helps to prevent outside air from being supplied to the three-way catalyst 140. This makes it possible to prevent oxygen-induced degradation of the three-way catalyst 140. This in turn makes it possible to reduce the amount of precious metals contained in the three-way catalyst 140, and reduce the cost of the three-way catalyst 140.

Modification

The foregoing description of the embodiment is directed to an exemplary configuration in which the exhaust passage 130 is negatively pressurized through reverse rotation of the engine 110. However, the configuration for achieving this is not limited as long as the configuration allows the exhaust passage 130 to be negatively pressurized.

Figure 6:
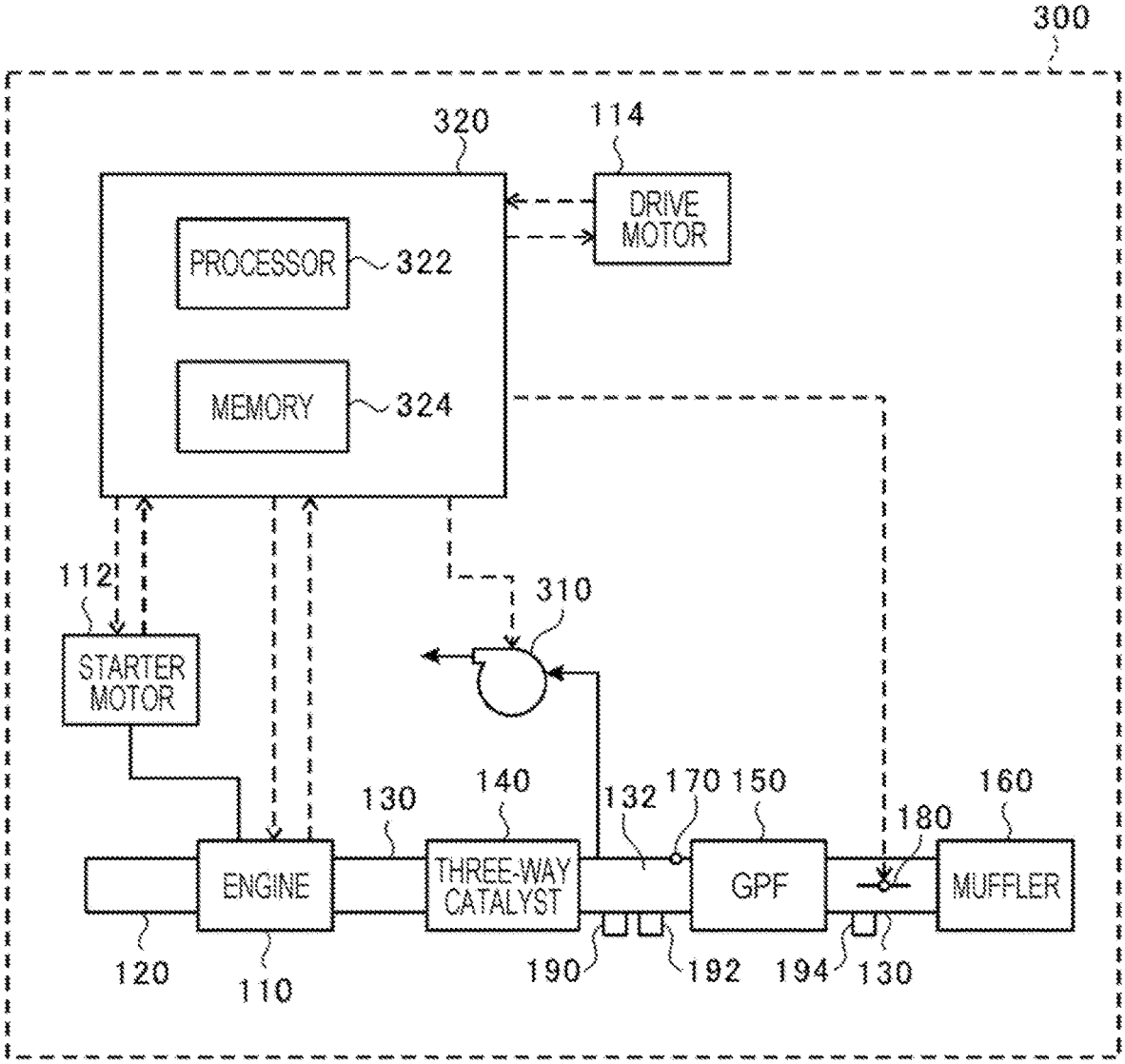
FIG. 6 is an illustration for explaining a vehicle according to a modification.

FIG. 6 is an illustration for explaining a vehicle 300 according to a modification. As illustrated in FIG. 6, the vehicle 300 includes the engine 110, the starter motor 112, the drive motor 114, the intake passage 120, the exhaust passage 130, the three-way catalyst 140, the GPF 150, the muffler 160, the first opening and closing mechanism 170, the second opening and closing mechanism 180, the oxygen sensor 190, the pressure sensors 192 and 194, a pump 310, and a controller 320. Components substantially equivalent to those of the vehicle 100 are designated by the same reference signs and not described repeatedly.

In one embodiment, the pump 310 may serve as the "negative-pressure mechanism". According to the modification, the pump 310 sucks in gas that exists in the region 132 of the exhaust passage 130. The suction side of the pump 310 is coupled to the region 132 of the exhaust passage 130. The discharge side of the pump 310 is open to the atmosphere. The pump 310 is operated by the starter motor 112.

In one embodiment, the controller 320 may serve as the "negative-pressure mechanism". The controller 320 includes one or more processors (hereinafter referred to simply as "processor") 322, and one or more memories (hereinafter referred to simply as "memory") 324. The processor 322 includes, for example, a central processing unit (CPU). The memory 324 includes, for example, a read only memory (ROM) and a random access memory (RAM). The ROM is a storage element that stores programs, computational parameters, and other data to be used by the CPU. The RAM is a storage element that temporarily stores variables, parameters, and other data to be used for processing to be executed by the CPU.

The controller 320 is configured to communicate with various devices disposed in the vehicle 300 (e.g., devices such as the engine 110, the starter motor 112, the drive motor 114, the second opening and closing mechanism 180, the oxygen sensor 190, the pressure sensors 192 and 194, and the pump 310). Communication between the controller 320 and each device is accomplished via, for example, Controller Area Network (CAN) communication.

Figure 7:
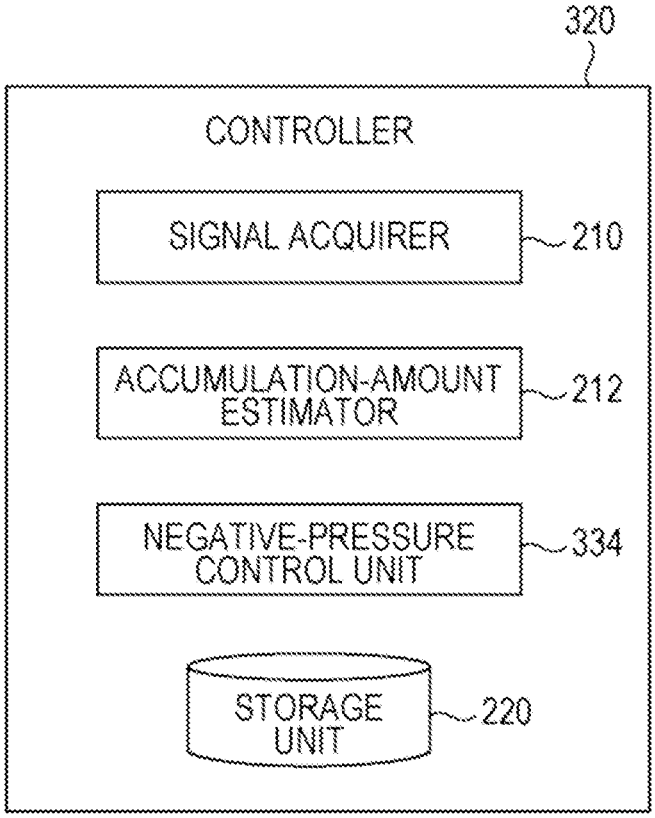
FIG. 7 is a block diagram illustrating an exemplary functional configuration of a controller according to the modification.

FIG. 7 is a block diagram illustrating an exemplary functional configuration of the controller 320 according to the modification. For example, as illustrated in FIG. 7, the controller 320 includes the signal acquirer 210, the accumulation-amount estimator 212, a negative-pressure control unit 334, and the storage unit 220. Various processes, including processes described later that are to be executed by the signal acquirer 210, the accumulation-amount estimator 212, and the negative-pressure control unit 334, may be executed by the processor 322. For example, various such processes are executed as the processor 322 executes a program stored in the memory 324.

The negative-pressure control unit 334 according to the modification is configured to, when the differential pressure between locations upstream and downstream of the GPF 150 becomes greater than or equal to a threshold pressure, and when the engine 110 is off and the vehicle 100 is being driven by the drive motor 114, control the starter motor 112 so as to activate the pump 310, and cause the pump 310 to suck in gas (e.g., exhaust gas) that exists within the exhaust passage 130. As with the negative-pressure control unit 214, the negative-pressure control unit 334 is configured to, in activating the pump 310, activate the second opening and closing mechanism 180 so as to close the exhaust passage 130. A portion of the exhaust passage 130 upstream of the second opening and closing mechanism 180 thus becomes negatively pressurized.

This causes the valve 174 of the first opening and closing mechanism 170 to pivot away from the opening 172 as the valve 174 is pushed by outside air toward the inner part of the exhaust passage 130. The opening 172 is thus opened by the valve 174. In this way, outside air is supplied into the exhaust passage 130 through the opening 172.

Then, when the oxygen concentration detected by the oxygen sensor 190 becomes greater than or equal to a predetermined threshold, the negative-pressure control unit 334 controls the starter motor 112 so as to deactivate the pump 310 and thereby release the negative pressure in the exhaust passage 130.

As described above, the vehicle 300 according to the modification likewise allows air (oxygen) to be supplied to the GPF 150 in a concentrated manner. This makes it possible to prevent oxygen from passing through the entire exhaust passage 130 from the engine 110 during execution of a regeneration process.

Although an embodiment of the disclosure has been described above with reference to the attached drawings, this is not intended to limit the disclosure to the embodiment. It will be readily appreciated that those skilled in the art would be able to arrive at various modifications or alterations within the scope of the disclosure as defined in the claims, and such modifications or alterations are also considered to be within the technical scope of the disclosure.

For example, the foregoing description of the embodiment and the modification is directed to an exemplary case where the opening 172 is located in a portion of the exhaust passage 130 between the three-way catalyst 140 and the GPF 150. However, the opening 172 may simply be located in a portion of the exhaust passage 130 upstream of the GPF 150. Alternatively, the opening 172 may be located in a portion of the exhaust passage 130 downstream of the GPF 150. In this case, the opening 172 may be located in a portion of the exhaust passage 130 downstream of the GPF 150 and upstream of the second opening and closing mechanism 180.

The foregoing description of the embodiment and the modification is directed to an exemplary case where the vehicle 100, 300 includes the second opening and closing mechanism 180. However, in one embodiment, the vehicle 100, 300 may include no second opening and closing mechanism 180.

The foregoing description of the embodiment and the modification is directed to an exemplary case where the vehicle 100, 300 includes the oxygen sensor 190. However, in one embodiment, the vehicle 100, 300 may include no oxygen sensor 190. In a case where the vehicle 100, 300 does not include the oxygen sensor 190, the negative-pressure control unit 214, 334 may release the negative pressure upon elapse of a predetermined amount of time after the negative pressurization of the exhaust passage 130.

The foregoing description of the embodiment and the modification is directed to an exemplary case where the three-way catalyst 140 is disposed in a portion of the exhaust passage 130 upstream of the GPF 150. However, the three-way catalyst 140 may be disposed in a portion of the exhaust passage 130 downstream of the GPF 150.

In the embodiment and the modification mentioned above, after the engine 110 is rotated in the reverse direction, the engine 110 may be rotated in the normal direction while the vehicle 100 is driven by the drive motor 114.

The foregoing description of the embodiment is directed to an exemplary case where the engine 110 is rotated in the reverse direction by the starter motor 112. However, the engine 110 may be rotated in the reverse direction by the drive motor 114. The engine 110 may be rotated in the reverse direction by another power source.

The foregoing description of the modification is directed to an exemplary case where the pump 310 is operated by the starter motor 112. However, the pump 310 may be operated by the drive motor 114. The pump 310 may be operated by another power source.

The foregoing description of the embodiment and the modification is directed to an exemplary case where the vehicle 100, 300 is a hybrid vehicle. However, the vehicle 100, 300 may be a vehicle that includes the engine 110 as a single drive source. In this case, the negative-pressure control unit 214, 334 may be configured to, while the engine 110 is off such as during an "idle stop" (i.e., shutting off of the engine when the vehicle is at rest), rotate the engine 110 in the reverse direction, or activate the pump 310.

The foregoing description of the embodiment is directed to an exemplary case where the engine 110 is a gasoline engine. However, the engine 110 may be a Diesel engine. In a case where the engine 110 is a Diesel engine, a DPF is disposed in the exhaust passage 130 instead of the GPF 150. In this case, the DPF may serve as a filter according to one embodiment of the disclosure.

The foregoing description of the embodiment is directed to an exemplary case where, after outside air is temporarily stored in the region 132 of the exhaust passage 130, the outside air is supplied to the GPF 150 when the engine 110 is rotated in the normal direction next time to thereby execute a regeneration process. However, a regeneration process may be executed by supplying the outside air to the GPF 150 before the engine 110 is rotated in the normal direction next time.

The controller 200 illustrated in FIG. 3 can be implemented by circuitry including at least one semiconductor integrated circuit such as at least one processor (e.g., a central processing unit (CPU)), at least one application specific integrated circuit (ASIC), and/or at least one field programmable gate array (FPGA). At least one processor can be configured, by reading instructions from at least one machine readable tangible medium, to perform all or a part of functions of the controller 200 including the signal acquirer 210, the accumulation-amount estimator 212, the negative-pressure control unit 214, and the storage unit 220. Such a medium may take many forms, including, but not limited to, any type of magnetic medium such as a hard disk, any type of optical medium such as a CD and a DVD, any type of semiconductor memory (i.e., semiconductor circuit) such as a volatile memory and a non-volatile memory. The volatile memory may include a DRAM and a SRAM, and the non-volatile memory may include a ROM and a NVRAM. The ASIC is an integrated circuit (IC) customized to perform, and the FPGA is an integrated circuit designed to be configured after manufacturing in order to perform, all or a part of the functions of the modules illustrated in FIG. 3.

The invention claimed is:

1. A vehicle comprising:

a filter disposed in an exhaust passage coupled to an engine;

a negative-pressure mechanism configured to pressurize a portion of the exhaust passage upstream of the filter to a negative pressure less than an atmospheric pressure; and a first opening and closing mechanism comprising an opening disposed in the exhaust passage, and a valve configured to selectively open and close the opening, the valve being configured to, when the exhaust passage becomes negatively pressurized by the negative-pressure mechanism, open the opening wherein the negative-pressure mechanism comprises a controller, the controller comprising one or more processors and one or more memories, the one or more memories being coupled to the one or more processors, and wherein the controller is configured to negatively pressurize the exhaust passage by causing the engine to rotate in a reverse direction, the reverse direction being opposite to a direction in which the engine is rotated in activating a drive system.

2. The vehicle according to claim 1, further comprising:

a second opening and closing mechanism disposed in a portion of the exhaust passage downstream of the opening, the second opening and closing mechanism being configured to selectively open and close the exhaust passage, wherein the second opening and closing mechanism is configured to, when the exhaust passage is negatively pressurized by the negative-pressure mechanism, close the exhaust passage.

3. The vehicle according to claim 1, further comprising:

an oxygen sensor disposed upstream of the filter, the oxygen sensor being configured to detect an oxygen concentration, wherein the negative-pressure mechanism is configured to, when the oxygen concentration becomes greater than or equal to a predetermined threshold, pressurize the exhaust passage to a pressure greater than or equal to the atmospheric pressure.

4. The vehicle according to claim 1, further comprising:

a three-way catalyst disposed in a portion of the exhaust passage upstream of the filter.

* * * * *